US010010158B2

(12) United States Patent
Do

(10) Patent No.: US 10,010,158 B2
(45) Date of Patent: Jul. 3, 2018

(54) WEARABLE CARRYING ACCESSORY

(71) Applicant: Level Terrain LLC, Broomfield, CO (US)

(72) Inventor: Mia Do, Broomfield, CO (US)

(73) Assignee: LEVEL TERRAIN LLC, Broomfield, CO (US)

( * ) Notice: Subject to any disclaimer, the term of this patent is extended or adjusted under 35 U.S.C. 154(b) by 0 days.

(21) Appl. No.: 14/929,936

(22) Filed: Nov. 2, 2015

(65) Prior Publication Data

US 2016/0051035 A1 Feb. 25, 2016

Related U.S. Application Data

(63) Continuation of application No. 13/598,337, filed on Aug. 29, 2012, now abandoned, which is a continuation of application No. 13/219,795, filed on Aug. 29, 2011, now abandoned.

(51) Int. Cl.

| | |
|---|---|
| ***A45F 3/00*** | (2006.01) |
| ***A45F 3/14*** | (2006.01) |
| *A45F 5/00* | (2006.01) |

(52) U.S. Cl.

CPC ..... *A45F 3/005* (2013.01); *A45F 3/14* (2013.01); *A45F 2003/144* (2013.01); *A45F 2005/008* (2013.01)

(58) Field of Classification Search

CPC ..... A45F 5/02; A45F 5/00; A45F 2005/008; A45F 5/021

USPC ..... 224/660, 222, 223, 587, 673, 674, 651, 224/661

See application file for complete search history.

(56) References Cited

U.S. PATENT DOCUMENTS

| | | | | |
|---|---|---|---|---|
| 29,490 | A * | 8/1860 | Varni-Gardinier ..... | A47J 19/06 100/97 |
| 776,193 | A | 11/1904 | Mills | |
| 1,418,371 | A | 6/1922 | Foster | |

(Continued)

FOREIGN PATENT DOCUMENTS

| | | |
|---|---|---|
| ES | 2177439 | 12/2002 |
| GB | 2050810 | 1/1981 |

(Continued)

OTHER PUBLICATIONS

International Search Report and Written Opinion of International (PCT) Patent Application No. PCT/US2012/052880, dated Feb. 1, 2013 12 pages.

(Continued)

*Primary Examiner* — Nathan J Newhouse
*Assistant Examiner* — Lester L Vanterpool
(74) *Attorney, Agent, or Firm* — Sheridan Ross P.C.

(57) ABSTRACT

A pouch for holding items is disclosed and is formed as a tube of a stretchable material with a plurality of openings therein. Items may be inserted through the openings and positioned within the pouch. The pouch may be manipulated to position the openings at various positions around the body. The openings may also be positioned on the outside, inside, top or other part of the pouch. The pouch has a substantially constant width to better camouflage items placed therein. The openings may include closures to prevent items from falling out. The pouch may be formed of a single circle or include closures for placing it around the body.

25 Claims, 5 Drawing Sheets

(56) References Cited

U.S. PATENT DOCUMENTS 1,478,497 A * 12/1923 Welch ..... A01K 97/06 224/0.5
1,486,470 A * 3/1924 Welch ..... A01K 97/06 224/245
1,920,061 A * 7/1933 Carr ..... A41F 9/002 2/247
2,004,412 A 6/1935 Luftig
2,004,477 A * 6/1935 Mather ..... A41F 9/002 2/300
2,321,808 A * 6/1943 Govan ..... A41F 9/002 2/300
2,351,158 A * 6/1944 Stelzer ..... A41F 9/002 150/102
2,596,884 A * 5/1952 Bailen ..... A41F 9/002 2/300
2,732,111 A * 1/1956 Fogle ..... F42B 39/02 206/3
3,931,917 A 1/1976 Zellmer
4,176,407 A * 12/1979 Goebel ..... A63B 71/148 2/161.1
4,277,847 A 7/1981 Florio
4,413,762 A * 11/1983 Carini ..... A45F 5/02 206/315.9
4,416,404 A * 11/1983 Daniels ..... A63B 47/001 206/315.9
4,433,803 A * 2/1984 Liberboim ..... A63B 47/001 224/251
4,446,574 A * 5/1984 Kalomeris ..... A45C 1/04 2/247
4,461,030 A 7/1984 Knudson
4,462,116 A * 7/1984 Sanzone ..... A45C 1/04 2/160
4,523,703 A * 6/1985 McKenna ..... A45F 3/00 224/660
4,569,465 A * 2/1986 O'Farrell ..... A45C 1/04 224/251
4,634,031 A * 1/1987 Frankhouse ..... A45C 1/04 224/602
5,060,835 A 10/1991 Payne
5,119,513 A * 6/1992 McKay ..... A41D 20/005 2/170
5,141,141 A 8/1992 Leone
5,150,824 A * 9/1992 Alvarez ..... A45C 7/0068 224/586
D334,471 S 4/1993 Yerby et al.
5,323,554 A 6/1994 MacDonald
5,353,975 A 10/1994 Libertucci
D358,705 S 5/1995 Saggese, Jr.
5,413,126 A 5/1995 Revson
5,425,719 A * 6/1995 Lessing, Jr. ..... A61M 25/02 224/660
5,452,476 A * 9/1995 Jenks ..... A41D 3/00 2/108
5,465,429 A * 11/1995 Rogers ..... F41C 33/0209 2/300
5,645,205 A 7/1997 Kennedy
5,671,481 A * 9/1997 Giard ..... A41D 20/00 2/170
5,704,531 A * 1/1998 Nam ..... A45F 3/00 224/235
5,794,769 A 8/1998 Tomlinson et al.
5,967,391 A 10/1999 Hunt
6,000,408 A 12/1999 Maturaporn
6,325,260 B1 * 12/2001 Gorham ..... A45C 1/04 206/69
6,349,414 B1 * 2/2002 Tillman ..... A41D 20/00 2/170
6,443,341 B1 * 9/2002 Rittmann ..... A45C 1/04 150/149
6,698,636 B2 3/2004 Angus et al.
D507,103 S 7/2005 Charles, Jr.
6,971,562 B2 * 12/2005 Willows ..... A45F 3/16 224/148.4
7,393,336 B2 7/2008 Sloot
7,574,753 B1 * 8/2009 Seyfried ..... A41D 27/085 2/311
7,735,682 B1 * 6/2010 Cassel ..... A47K 10/38 221/155
8,028,345 B2 * 10/2011 Waite ..... A41D 1/14 2/220
8,099,794 B2 1/2012 Carstens
D661,871 S * 6/2012 Savage ..... D2/742
8,286,267 B2 10/2012 Zuckerberg
D691,795 S 10/2013 Do
D724,316 S 3/2015 Nejjar
D731,786 S 6/2015 Chen
D738,618 S 9/2015 Do
D740,549 S 10/2015 Nejjar
D746,051 S 12/2015 Conway
D773,807 S 12/2016 Do
2003/0121946 A1 * 7/2003 Tai ..... A41F 9/002 224/587
2003/0189076 A1 * 10/2003 Shapess ..... A45C 1/04 224/587
2006/0196907 A1 9/2006 Pruitt
2006/0277660 A1 12/2006 MacMillan
2007/0084895 A1 * 4/2007 Bowen ..... A45C 1/04 224/660
2008/0073400 A1 3/2008 Swartz et al.
2008/0190980 A1 * 8/2008 Overton ..... A45F 3/14 224/664
2008/0217369 A1 9/2008 Sloot
2008/0230580 A1 * 9/2008 Rothschild ..... A41D 13/0015 224/660
2010/0200627 A1 * 8/2010 Shen ..... A45F 3/00 224/222
2013/0048687 A1 2/2013 Do
2013/0048695 A1 2/2013 Do

FOREIGN PATENT DOCUMENTS

| | | |
|---|---|---|
| JP | S61-7505 | 1/1986 |
| JP | 2000-199116 | 7/2000 |
| JP | 3121409 | 5/2006 |
| WO | WO 84/01790 | 5/1984 |
| WO | WO 99/63855 | 12/1999 |
| WO | WO 2013/033226 | 3/2013 |

OTHER PUBLICATIONS

Supplementary Search Report for European Patent Application No. 12827780.3, dated Aug. 14, 2015 8 pages.
Office Action dated Mar. 29, 2013 issued on Design U.S. Appl. No. 29/403,317, entitled "Waist Belt Carrier", filed Oct. 4, 2011 in the name of Mia Do.
Official Action for U.S. Appl. No. 13/219,795, dated Oct. 10, 2012 18 pages.
Official Action for U.S. Appl. No. 13/219,795, dated Jul. 17, 2013 16 pages.
Official Action for U.S. Appl. No. 13/598,337, dated Feb. 28, 2013 24 pages.
Official Action for U.S. Appl. No. 13/598,337, dated Dec. 20, 2013 17 pages.
Official Action for U.S. Appl. No. 13/598,337, dated Nov. 18, 2014 16 pages.
Official Action for U.S. Appl. No. 13/598,337, dated Jul. 1, 2015 14 pages.
Official Action for U.S. Appl. No. 13/598,337, dated Mar. 13, 2015 10 pages.
Official Action for Japan Patent Application No. 2014-528554, dated Sep. 6, 2016 3 pages.
Official Action for U.S. Appl. No. 29/502,518, dated Jul. 1, 2016 6 pages.

(56) References Cited

OTHER PUBLICATIONS

Notice of Allowance for U.S. Appl. No. 29/502,518, dated Sep. 12, 2016 7 pages.

* cited by examiner

WEARABLE CARRYING ACCESSORY

This application is a continuation of U.S. patent application Ser. No. 13/598,337, filed Aug. 29, 2012, which is a continuation of U.S. application Ser. No. 13/219,795, filed Aug. 29, 2011, entitled HIPBAND POUCH, the entirety of each is incorporated by reference herein.

FIELD OF THE INVENTION

The present article of manufacture relates to a wearable accessory for carrying one or more items. More particularly, it relates to a wearable pouch formed to create a smooth band worn about a portion of the body.

BACKGROUND OF THE INVENTION

Many individuals prefer to wear device/item holders about their body to avoid having to carry a purse or place keys or a wallet in their pockets. It is a common practice as well for individuals engaged in exercise activity and other sports to wear device/items holders in the form of arm bands or wristbands or athletic utility belts such as fanny packs. The packs allow the user to carry phones, music devices and/or other miscellaneous items during the physical activity. However, many of these packs are often too conspicuous or bulky, they are not stable against the body, items, are difficult to access and they do not offer flexibility of item placement and access. Often individuals do not like to wear anything that looks like a utility belt or fanny pack to hold only a few items even with the smallest versions of today's packs. Many will carry a few items such as phone/music devices, locker key/cards by hand rather than wear the typical waist pouch that looks like a fanny pack with separate pouch, belt and buckle. Previous designs even in the smallest form do not allow for easy access to items during physical activity, and various closures such as zippers are difficult to zip/unzip during activity.

Consequently, a need exists for a lightweight pouch that allows easy access to items stored within the pouch while allowing for a close comfortable fit by the wearer. Therefore, a need exists for a pouch which will accommodate different items during exercise, allows easy access to the items, prevents items from interfering with exercise, and does not distract from the appearance and clothing of the wearer.

SUMMARY OF THE INVENTION

According to one aspect of some embodiments of the present invention, a pouch is formed of an endless tubular member of elastic material having a hollow interior, a plurality of slits in spaced circumferential relation to one another along the tubular member and wherein each of the slits forms a normally closed opening in the tubular member which are spreadable for insertion of one or more articles into the interior and which slits return to a closed position whereby to retain the articles against accidental release from the tubular member. The tubular member, when stretched, assumes a flattened configuration and defines inner and outer substantially flat parallel sides, at least one of the sides having said circumferentially spaced slits. In this configuration the slits are urged to a closed position. The pouch may be defined by a plurality of stretchable layers, and the side with the spaced slits may be reversed to face inwardly.

The pouch may also be formed as a tube of material having openings therein. Items may be inserted through the openings and held in place within the tube of material, and the openings are separated by closed portions of the tube. The closed portions hold items in place. Since the pouch is formed of stretchable material, items of various sizes may be inserted through the openings. The stretchable material holds items securely within the tube of material, and closures may be used to partially seal the openings. The pouch may also be of substantially constant width throughout.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described below. Further, the Summary of the Invention is neither intended nor should it be construed as representing the full extent and scope of the present invention. The present invention is set forth in various levels of detail in the Summary of the Invention, and, in the attached drawings and the Detailed Description of the invention and no limitation as to the scope of the present invention is intended to either the inclusion or non-inclusion of elements, components, etc. in this summary of the invention. Additional aspects of the present invention will become more readily apparent from the detailed description, particularly when taken with the drawings

BRIEF DESCRIPTION OF THE DRAWINGS

The accompanying drawings, which are incorporated in and constitute a part of the specification, illustrate embodiments of the invention and together with the general of the invention given above and the detailed description of the drawings given below, serve to explain the principles of these inventions.

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Figure 1:
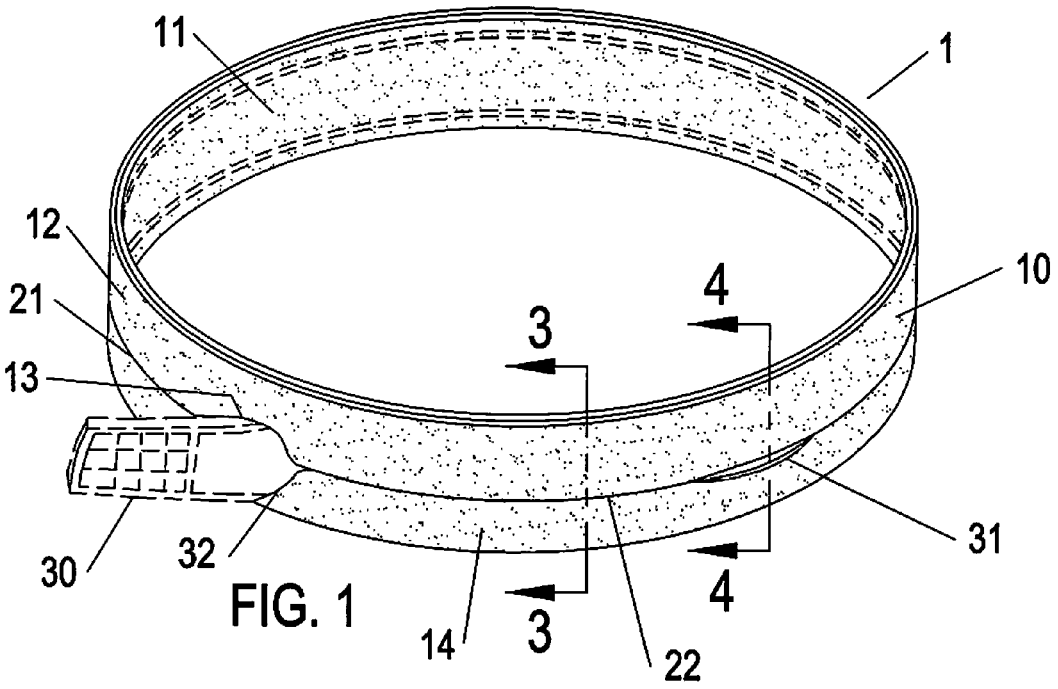
FIG. 1 is a front perspective view of a carrying accessory.
Figure 3:
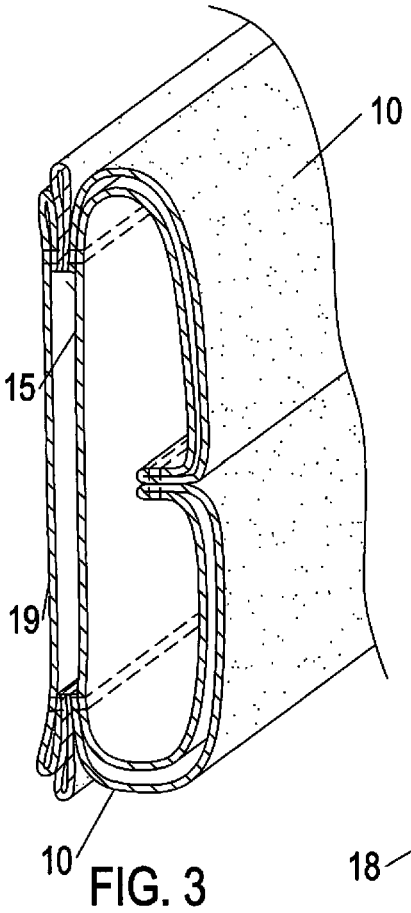
FIG. 3 illustrates a cross-section of the carrying accessory about lines 3-3 of FIG. 1.
Figure 4:
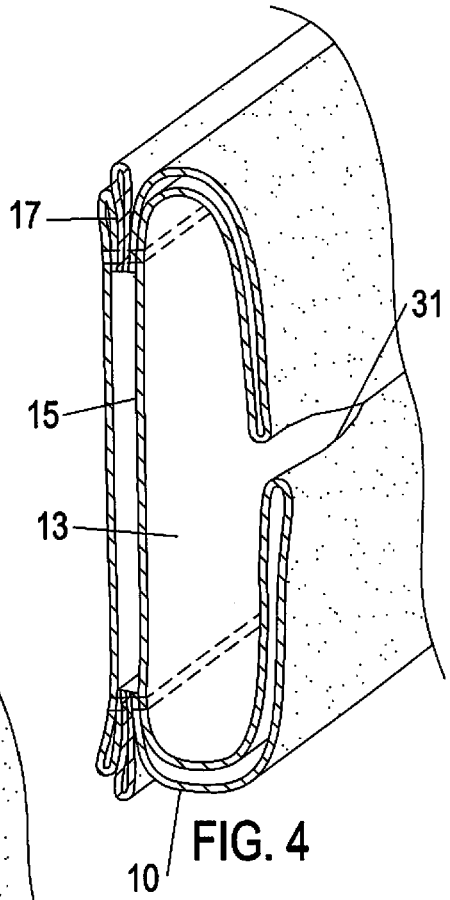
FIG. 4 illustrates a cross-section of the carrying accessory about lines 4-4 of FIG. 1.
Figure 5:
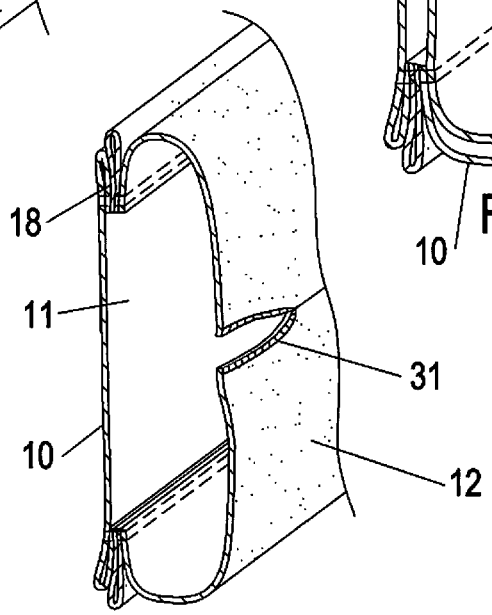
FIG. 5 is a view of a cross-section of an alternate form of carrying accessory.

The present article of manufacture is a stretchable pouch which can be worn for carrying items. An embodiment of the band pouch 1 is shown in FIG. 1 which illustrates a front perspective view. The band pouch may be formed from a one piece, seamless, elastic, stretchable, or expandable fabric 10 as shown in FIG. 5 or multiple layers of the same elastic, stretchable or expandable material 10, 15 and 19 may be attached together as shown in FIGS. 3 and 4. FIGS. 3 and 4 demonstrate a multiple layer configuration with an outer ply 19, inner ply 15 and hem stitching 17. The material 10 is stitched in a cylindrical or tubular manner leaving openings/slits 31 and 32 between sewn portions 21, 22 of the waist seam. The pouch 10 may be lined with another fabric 15 to create two plies. The material 10 may be a flexible fabric material that will stretch around the body part of the user for a snug fit. The material can be a performance fabric or cotton Lycra, spandex, or other outdoor recreational fabric with stretch so as to blend with clothing articles. In some forms, the lining or shell will be of water resistant material for water activity such as boating or beach goers or activity in the rain. The material of one embodiment of the present invention is soft and stretchy elastic/expandable fabric or other material that also has some surface friction so that the band does not slip from the body placement.

The material 10 is shaped to form an endless tubular member or resilient sleeve having an inner side 11 and outer side 12. The material 10 is shaped as a rectangle so that the band 10 has substantially constant width. The plurality of openings or slits 31 and 32 are in spaced circumferential relation to one another along the outer side 12 of the band 1. Between the slits 31 and 32 are the plurality of sealed portions 21 and 22. The slits 31 and 32 allow items to be inserted therethrough into an interior 13 of the tube of material. The sealed portions 21 and 22 help the band 1 to retain its shape and provide elastic tension of the material 10 about the items to hold them in place. Each of the slits form a normally closed opening in the tubular member 10 which are spreadable for insertion of one or more articles into the interior 13 and which slits return to a closed position to retain the articles against accidental release or removal from the tubular member 10. The tubular member, when stretched, defines the inner and outer substantially flat parallel sides 11 and 12, at least one of the sides 11 or 12 having at least one of the circumferentially spaced slits, 31 or 32.

The pouch is formed as an endless tubular member to be worn about a part of the body. It is stretchable so that it will form tightly about the body, remain in place and hold the items without movement. The pouch is sized to fit around the wearer's hip or waist but is also conformable and sized to encircle a portion of a human body such as an ankle, wrist or upper arm. The pouch of one embodiment is of substantially consistent width. In this manner, it may appear as a part of the clothing, such as a waistband, worn by the wearer.

The present article allows the tension of the band to hold items in the pouch snuggly without creating an obvious bulge in a pouch. When small objects are placed into the band they are neatly hidden in the thickness and width of the band. The consistent width all around may be the same width or wider as a cell phone in horizontal placement. Other embodiments can be adapted such as varying width to fit other wider or narrower objects.

FIG. 1 also illustrates the placement of item 30 within the band pouch 1. Items may include keys, phone/music devices, credit cards, tissues, gum, etc. The band pouch is even and consistent in design all around allowing for flexible placement of the band on the body because the appearance is consistent. Of course, because the material is stretchable and resilient, the band pouch 1 can accommodate items which may be somewhat larger than the width of the band pouch 1. The material flexes to allow placement of the larger items, and the construction and design described herein allow the band pouch to hold multiple items, throughout the belt while maintaining a look that blends with the wearer's other garments.

Figure 6:
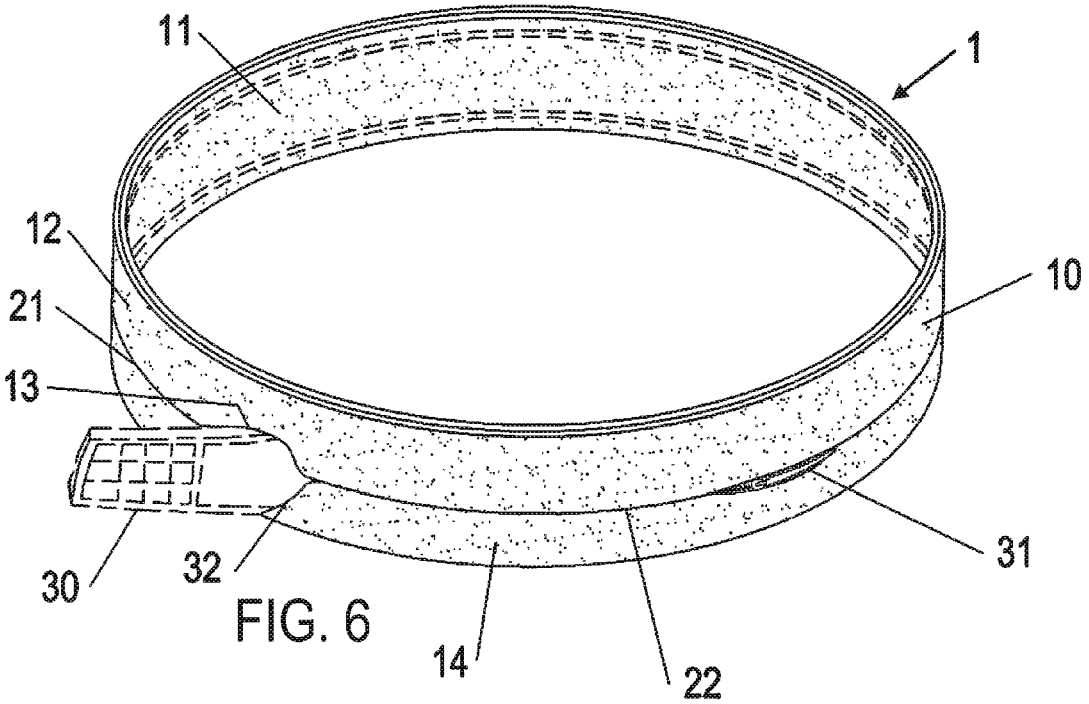
FIG. 6 shows a releasable closure on slit 31 of the embodiment shown in FIG. 1.
Figure 7:
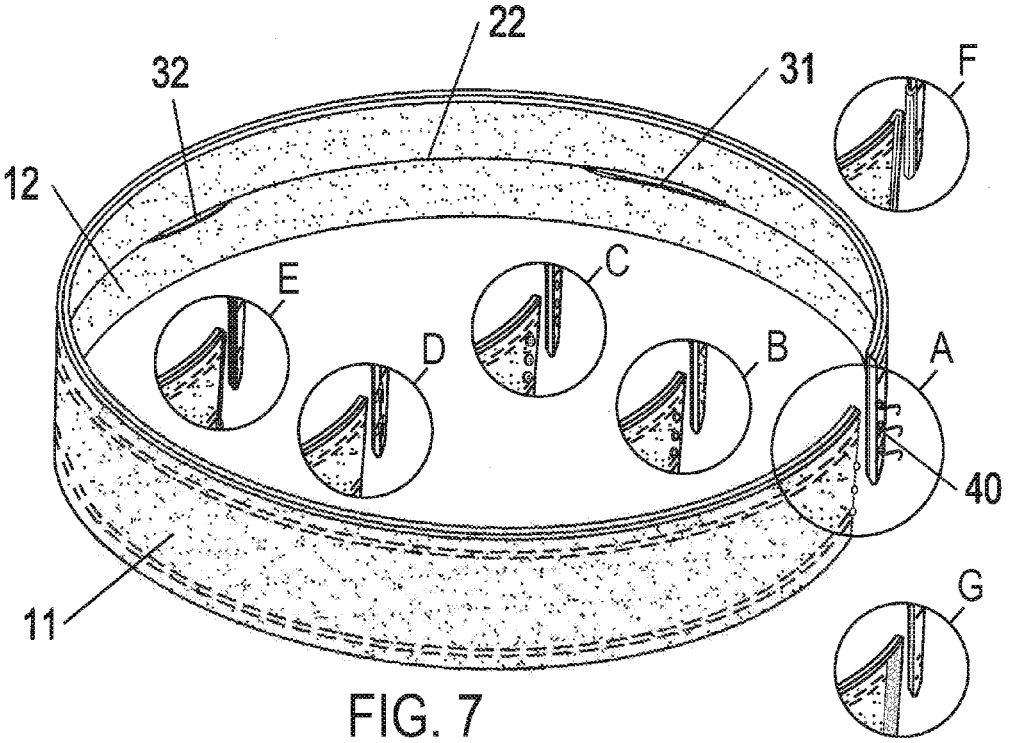
FIG. 7 shows a releasable closure on seam 40 of the embodiment shown in FIG. 2.
Figure 8:
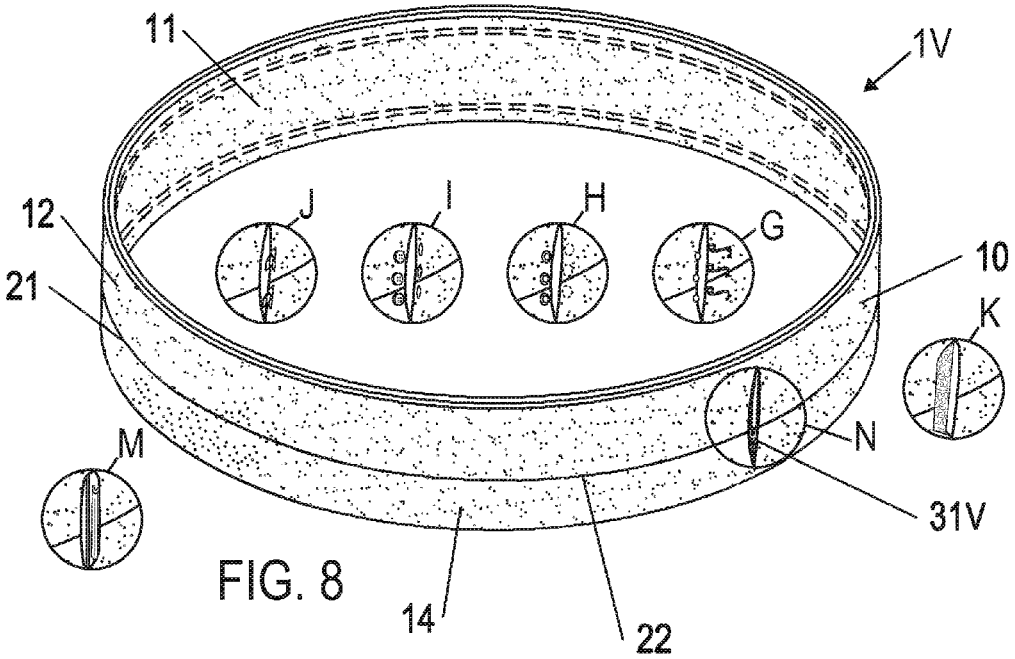
FIG. 8 shows a top perspective view of embodiment 1V with a vertical slit 31V.
Figure 9:
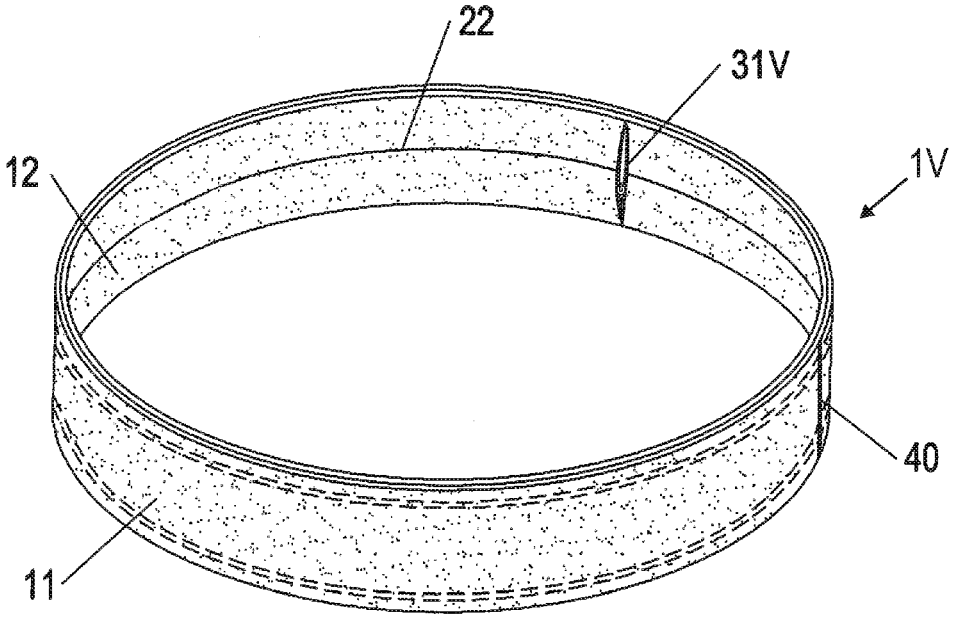
FIG. 9 shows embodiment 1V reversed.

The band pouch 1 is formed as an endless circle and may have a seam 40 at the ends of the tube of material. Alternatively, the ends of the tube of material may be releasably attached together using any known methods, as shown in FIGS. 6-7. Such methods, shown in FIG. 7, may include connectors including, clips (FIG. 7, F), latches (FIG. 7, D), buttons (FIG. 7, C), hooks (FIG. 7, A), hook and loop fasteners (FIG. 7, G), zipper (FIG. 7, E), etc. (see FIG. 7, seam 40, and circled releasable closure options A-G). Alternatively, the material may be formed as a single circle of material without any side seam. The multiple slits, 31 and 32, or 31V, shown in FIGS. 1-9, allow items to be inserted anywhere around the band pouch 1, or 1V.

A single slit may be sufficient, but multiple slits allow improved placement of materials. The tubular nature of the band pouch 1, or 1V, allows items to be stored throughout the interior of the band even in the backside, and items can be moved horizontally within the belt to the desired placement of the wearer. For example, a phone could be inserted in the front and retrieved from any of the slits 31 or 32, or 31V. Separate, distinct openings may be formed as well in the pouch 1, or 1V, so that various items may be kept separate within the pouch 1 or 1V.

Figure 4A:
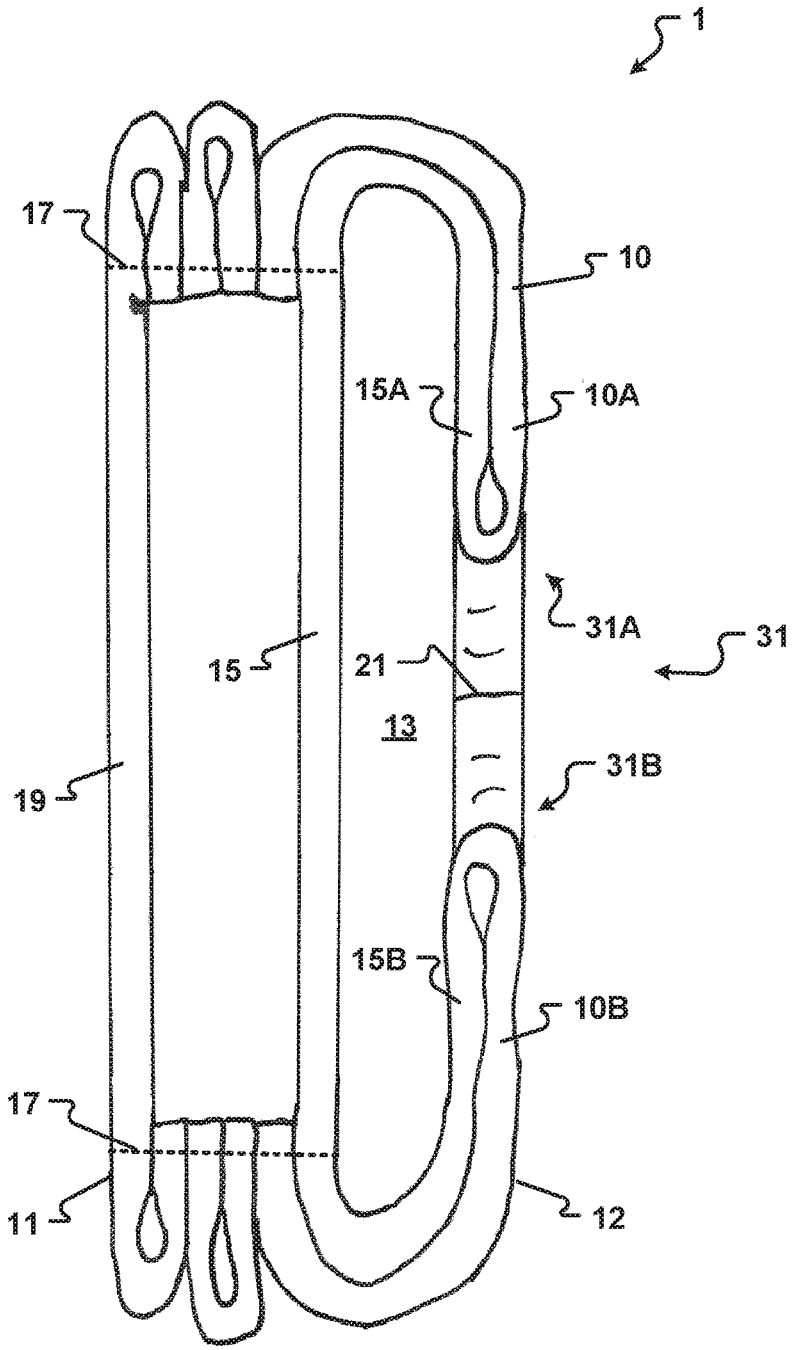
FIG. 4A is another view of the carrying accessory of the embodiment shown in FIG. 4.

As shown in FIG. 4A, the band pouch 1 generally comprises a first outer fabric layer 19 associated with a second outer fabric layer 10. An inner fabric layer 15 is positioned between the first and second outer fabric layers 19, 10 to form a pocket with an interior space 13. The pocket includes an opening 31 in an outer side 12 of the band pouch 1. The inner fabric layer 15 is continuous from a first side 31A of the opening 31 to a second side 31B of the opening 31. More specifically, a first portion 15A of the inner fabric layer 15 is interconnected to a first portion 10A of the second outer fabric layer 10. Similarly, a second portion 15B of the inner fabric layer 15 is interconnected to a second portion 10B of the second outer fabric layer 10. Optionally, the first and second outer fabric layers 19, 10 are sewn together, for example, by stitching 17.

In another form, as shown in FIG. 5, a generally rectangular piece of fabric can be stitched to the lining on the long edges 18 then turned inside out. This single 2 ply rectangle can then be folded over (so that the top edge is brought to the bottom edges) to enclose an internal volume. The sewing will leave openings along the brought together edges so they can act as the pouch openings. This tube is then wrapped where the ends are stitched together to finish the circle band.

A band pouch design used in some alternate forms makes it easier to provide/manufacture bands in various colors and patterns as in simple clothing accessories. This allows production to more easily incorporate a variety of colors at lower cost to produce. The different colors and patterns can make the user with the basic black legging appear to change outfit with different band pouch changes.

One form of pouch will have a width of approximately 3" to comfortably enclose a cell phone placed horizontally in the belt. In other alternate forms, the band pouch will also have wider widths and elasticity, that is, the pouch will act as a compression band to accentuate the waistline or control the extra belly appearance. The band can act as a 'control top' as well as a pouch for small items.

Figure 2:
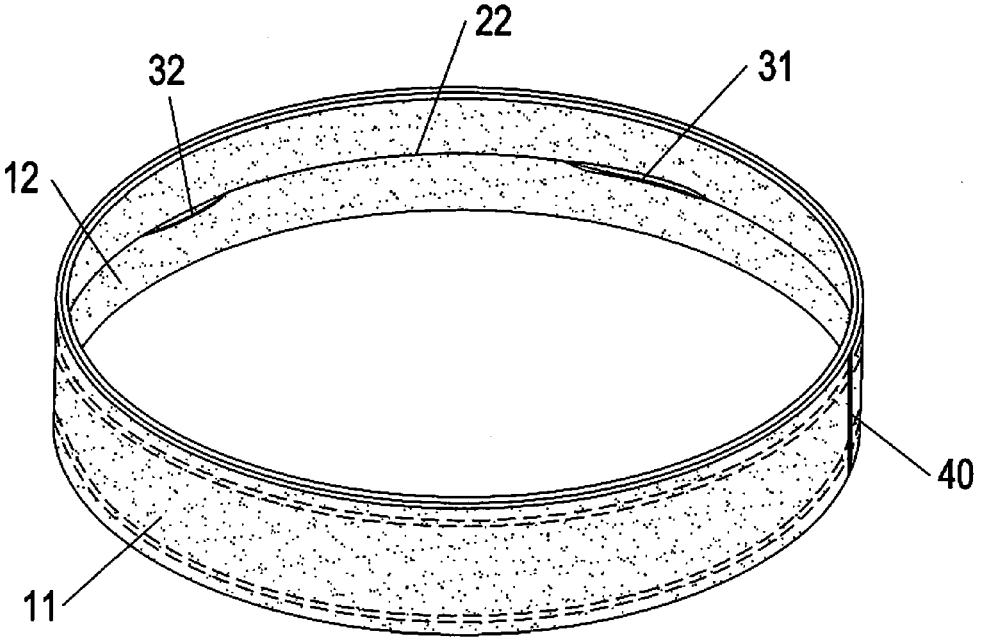
FIG. 2 is a reverse perspective view of the carrying accessory according to the embodiment shown in FIG. 1.

As illustrated in FIGS. 1 and 2, the openings 31 and 32 extend along the length of the band 1. Alternatively, openings could be formed which are vertical and extend perpendicular to the band 1, as shown by 31V in FIGS. 8 and 9. With vertical openings added opening restrictions, such as hook and loop fasteners (FIG. 8, K), snaps (FIG. 8, H), buttons (FIG. 8, I), or zippers (FIG. 8, N), hooks (FIG. 8, L), latch (FIG. 8, J), or clip (FIG. 8, M), may be used to retain items within the pouch, shown by FIG. 8, with circled options F-N). Alternatively, a simple smaller opening than the width of the band 1, or 1V, as in FIGS. 8 and 9, with notch stitch on either end of the slit will keep items in the band during horizontal position activities.

The openings of one embodiment have a clean finished face side of a seam (where the shell and lining are stitched together and turned inside out creating a tube with the seam allowance hidden). The stitch may be an over-lock stitch that allows the fabric to stretch around the opening. The opening measurements are approximately 3" to comfortably slip a phone/device through or stretch for a bigger object. The stitched portion from opening to opening is approximately 2"-5" with the longer stitched closure wide enough to cover the entire phone/device under the closure/seam. The placements of the openings and length of the closures may be evenly distributed with two openings in the front and two in the back. However, these can change depending on intended objects and use such as phone, tissue, key, gum for the gym or small wallet, granola/power bar, suntan lotion for a hike or walk.

The band of one embodiment of the present invention is worn on the body of the user with non-smooth stretch material. For example, the stretch will be equivalent to waistbands found in women's activewear hence a need for sizes will be necessary. The sizes will be similar to the activewear bottoms, such as S, M, L. Each size will be cut in similar grading lengths as activewear bottoms waistband.

In the previous embodiments, the band 1 is formed with openings on the outer side 12. Because the band 1 is formed as a tube, the openings can be placed in different positions to allow for different looks, uses, and security. FIG. 2 shows turning the band 1 inside out or reversing the outer layer 12 to face the inside, so that the openings 31, 32 face the wearer's body. When worn against the body the items are secure as the openings are fully sealed by the wearer's body. The openings can also be turned upward for easy access of items.

In disclosed embodiments, the band 1 functions as a visible garment worn outside other clothing. The band 1 has a smooth look adding to the fashion and appearance of garments. Alternatively, the band 1 may be worn under other clothing. Since the band 1 holds items tightly and provides a smooth look, the band 1 may be used under other clothing without creating visible bulges. The band 1 may be used as well as a security belt.

It is therefore to be understood that while different embodiments are hereinafter set forth and described, the above and other modifications may be made therein without departing from the spirit and scope of the article of manufacture as defined by the appended claims and reasonable equivalents thereof.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A band adapted to be worn about a user's waist, comprising:

a first piece of elastic or stretchable fabric comprising:
- a top side;
- a bottom side;
- a first end;
- a second end connected to the first end to form a continuous loop; and
- a first central portion separating the top side from the bottom side and the first end from the second end;

a second piece of elastic or stretchable fabric comprising:
- a second central portion;
- a top edge folded downward toward the second central portion to form an upper portion with an upper folded edge, the top edge sewn to the first piece of elastic or stretchable fabric proximate the top side and the upper folded edge folded downward past the top edge;
- a bottom edge folded upward toward the second central portion to form a lower portion with a lower folded edge, the bottom edge sewn to the first piece of elastic or stretchable fabric proximate the bottom side, and the lower folded edge folded upward past the bottom edge, a portion of the lower folded edge sewn to a portion of the upper folded edge to define a second outer fabric layer;
- wherein the second central portion separates the first piece of elastic or stretchable fabric from the upper folded edge and the lower folded edge; and an interior storage volume formed by the second central portion, the upper portion, and the lower portion, the interior storage volume accessible via at least one slit between the upper folded edge and the lower folded edge.

2. The band of claim 1, further comprising a fourth fabric layer positioned at least partially between the first piece of elastic or stretchable fabric and the top edge, wherein an upper circumferential seam connects the first piece of elastic or stretchable fabric, the fourth fabric layer, and the top edge.

3. The band of claim 1, wherein the at least one slit is oriented in a direction that is about parallel to a circumferential direction of the band.

4. The band of claim 1, wherein the at least one slit is oriented in a direction that is about perpendicular to a circumferential direction of the band.

5. The band of claim 1, wherein the at least one slit is biased into a closed position when the band is worn about a user's waist.

6. The band of claim 1, wherein the at least one slit comprises a plurality of slits.

7. The band of claim 6, wherein one of the plurality of slits is associated with a zipper that selectively opens and closes the one of the plurality of slits.

8. The band of claim 1, wherein the first piece of elastic or stretchable fabric and the second piece of elastic or stretchable fabric are made of the same material.

9. The band of claim 1, wherein the first end is removably connected to the second end.

10. The band of claim 1, wherein the first piece of elastic or stretchable fabric and the second piece of elastic or stretchable fabric are sewn together by at least one of an upper circumferential seam and a lower circumferential seam.

11. The band of claim 10, wherein the at least one of an upper circumferential seam and a lower circumferential seam is an upper circumferential seam, and the first piece of elastic or stretchable fabric comprises a fold proximate the top side such that the upper circumferential seam passes through the first piece of elastic or stretchable fabric twice.

12. The band of claim 11, wherein the fold forms a loop closed by the upper circumferential seam.

13. The band of claim 12, further comprising a third piece of fabric between the loop and the second piece of elastic or stretchable fabric, such that the upper circumferential seam passes through each of the first piece of elastic or stretchable fabric, the second piece of elastic or stretchable fabric, and the third piece of fabric.

14. The band of claim 13, wherein the third piece of fabric is folded such that the upper circumferential seam passes through the third piece of fabric twice to form a second closed loop.

15. The band of claim 1, wherein the at least one slit comprises a plurality of slits and a seam runs from a first end of a first one of the plurality of slits to a second end of a second one of the plurality of slits.

16. The band of claim 1, wherein the upper folded edge and the lower folded edge are sewn together with a stitch that allows the second outer fabric layer to stretch around the at least one slit.

17. The band of claim 1, wherein the second piece of elastic or stretchable fabric is made of a water-resistant material.

18. The band of claim 1, wherein the first piece of elastic or stretchable fabric can be reversed from a position adjacent to the user's waist to a position spaced from the user's waist by at least the second central portion.

19. A carrying accessory adapted for wear around a user's waist, comprising:

an elastic or stretchable fabric tube comprising an upper portion and a lower portion opposite the upper portion, the fabric tube further comprising a first fabric piece, a second fabric piece, an upper material piece, and a lower material piece, wherein the first fabric piece is sewn to the second fabric piece and the upper material piece with a first circumferential seam along the upper portion, the first fabric piece is sewn to the second fabric piece and the lower material piece with a second circumferential seam along the lower portion, and the second fabric piece includes at least one circumferential aperture forming a pocket opening, the aperture positioned between the upper portion and the lower portion;

an inner fabric lining interconnected to the fabric tube at a first edge of the aperture, at a second edge of the aperture, along the upper portion of the fabric tube, and along the lower portion of the fabric tube to define a pocket positioned within the tube, the inner fabric lining being continuous from the first edge of the aperture to the second edge of the aperture such that an interior volume of the pocket is spaced from the fabric tube by the inner fabric lining.

20. The carrying accessory of claim 19, further comprising a plurality of apertures.

21. The carrying accessory of claim 19, wherein the fabric tube comprises a closure mechanism that secures a first end of the fabric tube to a second end of the fabric tube to form a continuous loop.

22. The carrying accessory of claim 19, wherein when said carrying accessory is worn about the user's waist, the aperture is biased into a closed position and an outer side of the carrying accessory is adapted to conform to the user's body.

23. The carrying accessory of claim 19, wherein the inner fabric lining is sewn to the fabric tube by a stitch that allows the fabric tube to stretch around the aperture.

24. A band adapted to be worn about a user's waist, comprising:

a back section of stretchable fabric having an upper edge, a lower edge, a first end, and a second end, the upper edge parallel to the lower edge, the back section forming a continuous loop when the first end and the second end are connected;

an upper front section of stretchable fabric having a first edge aligned with and secured to the upper edge with an upper circumferential stitch, the upper front section extending from the first edge toward the lower edge and having a second edge parallel to the first edge, the second edge positioned between the upper edge and the lower edge;

a lower front section of stretchable fabric having a third edge aligned with and secured to the lower edge with a lower circumferential stitch, the lower front section extending from the third edge toward the upper edge and having a fourth edge parallel to the third edge;

a plurality of seams securing the upper front section to the lower front section; and a plurality of apertures between the upper front section and the lower front section, each of the plurality of apertures positioned between two of the plurality of seams.

25. The band of claim 24, wherein at least one of the plurality of seams is a circumferential seam running from a first end of a first one of the plurality of apertures to a second end of a second one of the plurality of apertures.

* * * * *